United States Patent [19]

Duke et al.

[11] Patent Number: 4,911,684

[45] Date of Patent: Mar. 27, 1990

[54] SMOKING ARTICLE MOUTHPIECES

[75] Inventors: Martin G. Duke, Southampton; Peter R. White, Romsey, both of England

[73] Assignee: British-American Tobacco Company Limited, London, England

[21] Appl. No.: 835,529

[22] Filed: Mar. 3, 1986

[30] Foreign Application Priority Data

Mar. 14, 1985 [GB] United Kingdom ..... 8506594

[51] Int. Cl.[4] ..... A24C 5/50; A24D 3/04

[52] U.S. Cl. ..... 493/42; 493/43; 131/336

[58] Field of Search ..... 131/336, 339, 340, 341, 131/361, 94; 493/43, 42

[56] References Cited

U.S. PATENT DOCUMENTS

| | | | |
|---|---|---|---|
| 2,958,328 | 11/1960 | Bartolomeo | 131/336 |
| 3,045,680 | 7/1962 | Smith | 131/336 |
| 3,124,143 | 3/1964 | Bartolomeo | 131/336 |
| 3,389,705 | 6/1968 | Levavi | 131/340 |
| 3,678,941 | 7/1972 | Dixon | 131/340 |
| 4,149,546 | 4/1979 | Luke et al. | 131/94 |
| 4,273,141 | 6/1981 | Van Tilburg | 131/340 |
| 4,388,934 | 6/1983 | Luke | 131/340 |
| 4,525,161 | 6/1985 | Luke | 131/341 |

FOREIGN PATENT DOCUMENTS

| | | |
|---|---|---|
| 0119693 | 9/1984 | European Pat. Off. . |
| 1507765 | 4/1978 | United Kingdom . |
| 2100573 | 1/1983 | United Kingdom . |

*Primary Examiner*—V. Millin

*Attorney, Agent, or Firm*—Kane, Dalsimer, Sullivan, Kurucz, Levy, Eisele and Richard

[57] ABSTRACT

A method of making a ventilated cigarette filter plug in which a bore is thermally formed, by a laser beam for example, in a rod comprising a duct extending coaxially of the rod and matrix material surrounding the duct. The thermally formed bore extends through the matrix material to provide air-flow communication between the periphery of the rod and the interior of the duct.

7 Claims, No Drawings

SMOKING ARTICLE MOUTHPIECES

BACKGROUND OF THE INVENTION

1. Field of the Invention

This invention relates to smoking article mouthpieces, filters for example, and to the manufacture thereof.

2. Brief Description of the Prior Art

In United Kingdom Patent Specification No. 2 100 573 A there is described a cigarette filter in the use of which ventilation air issues from the centre of the mouth end of the filter and tobacco smoke issues from the remaining proportion of the mouth end of the filter. The central jet of air affects the pattern of the surrounding smoke and this in turn affects the smoker's sensory perception of the smoke. However, the filter is of complex construction and may be difficult to make. It is an object of the invention to provide a simple method of making a filter, which filter nevertheless provides a sensory effect similar to that of the Specification No. 2 100 573 A.

SUMMARY OF THE INVENTION

The present invention provides a method of providing ventilation means in smoking-article mouthpiece rod, wherein a linear bore is thermally formed in a rod comprising a duct extending co-axially of said rod and matrix material surrounding said duct, said bore extending through said matrix material and serving to provide air-flow communication between the periphery of said rod at a first location and the interior of said duct.

The bore is preferably formed by directing a laser beam at the mouthpiece rod. Alternatively, but less advantageously, a heated pin may be inserted into the rod to form the bore. The provision of the bore, by whatever method of formation, does not alter the peripheral conformation of the rod.

Suitably, the matrix material is a low density thermoplastic material, such as a cellulose acetate or polypropylene fibrous or foamed material. If the material is foamed, i.e. polycellular, it may be of open or closed cell form. The body of matrix material surrounding the duct may be self-sustaining. If it is not self-substaining, the filter rod will comprise an outer plugwrap, which plugwrap is pierced when the bore is formed. If the matrix material is inherently gas-pervious, it may be rendered gas-impervious by, for example, the application of a barrier layer to the body of matrix material.

The duct may be in the form of a length of tubing formed of, for example, a paper, reconstituted tobacco, or a plastics material. Alternatively, the duct may take the form of a bore in the matrix material.

The formation method used to form the linear bore intercommunicating the periphery of the rod and the interior of the duct suitably forms a second bore which intercommunicates the interior of the duct and the periphery of the rod at a second location diametrically opposed to the first location.

Advantageously, the linear bore(s) is/are formed in the rod when the rod is being moved in a direction transverse to the longitudinal axis thereof.

Rods operated upon in accordance with the present invention are advantageously of a length a multiple of a unit plug length, sixfold unit length for example.

The walls of the duct should preferably be of zero or low gas permeability.

Preferably, the duct extends from end-to-end of the rod. The matrix material too, preferably extends from end-to-end of the rod.

The or each thermally formed linear bore suitably extends perpendicularly of the duct.

The duct may be obturated at a location to one side of the location of the intersection of the duct and the linear bore(s). The obturation may be effected by, for example, pinching together the walls of the duct or by use of a blocking piece disposed within the duct.

BRIEF DESCRIPTION OF THE DRAWINGS

In order that the invention may be clearly understood and readily carried into effect, reference will now be made, by way of example, to the accompanying diagrammatic drawing, in which:

FIG. 1 shows, in axial section, a cigarette filter plug;

FIG. 2 shows a cross-sectional view of the filter plug of FIG. 1, the section being taken at the line II—II of FIG. 1; and FIG. 3 shows, in axial section, a cigarette filter plug of a form a modification of that of FIG. 1.

DETAILED DESCRIPTION OF THE PREFERRED EMBODIMENTS OF THE INVENTION

The cigarette filter plug shown in FIGS. 1 and 2 comprises polyethylene tubing 1 of an internal diameter of 1.4 mm. The tubing 1 extends co-axially of the filter plug and is surrounded by matrix material 2 in the form of fibrous cellulose acetate. The filter plug is enwrapped in a thermoplastic plugwrap 3 which may, for example, be a plugwrap of a type described in European Patent Specification No. 0 119 693.

The filter plug, preferably when forming part of a filter rod a multiple of the plug length, is operated on to provide an annular groove 4. A thermal moulding process is preferably used to form the groove 4, such process having the advantage of distributing the thermoplastic plugwrap material as a continuous, gas impervious film over the walls of the groove 4. The process may be carried out using apparatus generally constructed and operative as described and illustrated in United Kingdom Patent Specification No. 1,507,765.

After the filter plug of FIGS. 1 and 2 has been provided with the groove 4, laser apparatus, a laser head 5 of which is shown in FIG. 1, is used to thermally form diametrically aligned bores 6 and 7. Each of the bores 6, 7 opens at one end thereof at the base of the groove 4, extends radially through material 2, and at the other end thereof opens at the interior of tubing 1. The bores 6,7 are produced by a single pulse of laser energy emanating from the head 5.

The thermal formation of the bores 6,7 results in the walls thereof being somewhat thermally sealed, although the formation process does not render the walls of the bores 6,7 gas impermeable.

As an alternative to the use of a beam of laser energy for forming the bores 6,7 through the cellulose acetate matrix material 2 and the wall of the tubing 1, similar bores can be formed using a heated metal pin. Such a pin, designated by reference numeral 8, is shown diagrammatically adjacent the filter plug of FIG. 3. The use of a heated pin also results in a partial thermal sealing of the walls of the bores 6,7.

The filter plug of FIG. 3 is similar to that of FIGS. 1 and 2 and thus corresponding parts have been given corresponding reference numerals, excepting that the reference numerals on FIG. 3 are increased by the value of ten. As may be observed from FIG. 3, the tubing 11 is closed at the left-hand end thereof. Such closure may be effected by revolving a multi unit length rod, of which the plug initially formed a section, in contact with a heated former 9 while moving the former 9 radially inwardly of the rod. The action of the heated former 9 on the multi unit length rod serves two purposes, namely to separate adjacent unit length sections of the rod and to close, by thermal welding, the tubing 11.

When the filter plugs of FIGS. 1 and 3 are incorporated in cigarettes, a tipping overwrap is employed to interattach the filter plug to a tobacco rod, which rod (not shown) extends to the left as viewing FIGS. 1 and 3. 3. The tipping overwrap is provided with a line(s) or zone of ventilation perforations which overlie the annular groove 4,14. Thus when the cigarette is smoked, ventilating air is drawn through the perforations into the groove 4,14 and thence through the bores 6,7; 16,17 into the tubing 1,11.

It has been determined that when a cigarette incorporating a filter plug as per FIG. 1 is smoked at a puff rate of 17.5 cc/sec and the level of filter ventilation is 60%, typically 50% of the total smoke passing from the cigarette to the filter plug flows from the filter plug through the tubing 1. This means that the ratio of air to smoke which flows from the tubing 1 is about 3:1.

It has also been determined that when a cigarette incorporating a filter plug as per FIG. 3 is smoked, some smoke, although only a small proportion of that entering the filter plug, flows into the bores 16,17 through the walls thereof and thence flows from the plug, together with ventilating air, through the tubing 11.

If in the use of either of the filter plugs the tubing 1,11 becomes blocked at a location downstream of the bores 6,7; 16,17, the ventilation level changes to only a small degree.

Although in each of the above described filter plugs there is a single pair of diametrically aligned bores 6,7; 16,17, it will be appreciated that there could be provided a second, similar pair of such bores, preferably extending substantially perpendicularly of the bores 6,7; 16,17. Indeed, more than two pairs of diametrically aligned bores could be provided, preferably equiangularly spaced of the plug.

What is claimed is:

1. A method of providing ventilation means in a smoking-article mouthpiece rod, which comprises; thermally forming a linear bore in the rod, said rod comprising a duct extending co-axially of said rod and matrix material surrounding said duct, said bore extending through said matrix material and serving to provide air-flow communication between the periphery of said rod at a first location and the interior of said duct.

2. A method according to claim 1 wherein said bore is formed by directing a laser beam at said rod.

3. A method according to claim 1, wherein said bore is formed by inserting a heated pin into said rod.

4. A method according to claim 1, wherein a further linear bore is thermally formed in said rod, said further bore extending through said matrix material and serving to provide air-flow communication between the periphery of said rod at a second location and the interior of said duct.

5. A method according to claim 4, wherein said second location is disposed diammetrically opposite said first location.

6. A method according to claim 5, wherein said further bore is axially aligned with the first mentioned bore.

7. A method according to claim 1, wherein the or each linear bore is formed while said rod is being moved in a direction transverse to the longitudinal axis of said rod.

* * * * *

UNITED STATES PATENT AND TRADEMARK OFFICE

CERTIFICATE OF CORRECTION

PATENT NO. : 4,911,684

DATED : March 27, 1990

INVENTOR(S) : Martin G. Duke, et al.

It is certified that error appears in the above-identified patent and that said Letters Patent is hereby corrected as shown below:

The title Page should be deleted to appear as per attached title page.

The sheet of drawing consisting of figs. 1, 2 and 3, should be added as per attached sheet.

Signed and Sealed this

Eleventh Day of February, 1992

*Attest:*

HARRY F. MANBECK, JR.

*Attesting Officer*

*Commissioner of Patents and Trademarks*

United States Patent [19]

Duke et al.

[11] Patent Number: 4,911,684

[45] Date of Patent: Mar. 27, 1990

[54] SMOKING ARTICLE MOUTHPIECES

[75] Inventors: Martin G. Duke, Southampton; Peter R. White, Romsey, both of England

[73] Assignee: British-American Tobacco Company Limited, London, England

[21] Appl. No.: 835,529

[22] Filed: Mar. 3, 1986

[30] Foreign Application Priority Data

Mar. 14, 1985 [GB] United Kingdom ..... 8506594

[51] Int. Cl.[4] ..... A24C 5/50; A24D 3/04

[52] U.S. Cl. ..... 493/42; 493/43; 131/336

[58] Field of Search ..... 131/336, 339, 340, 341, 131/361, 94; 493/43, 42

[56] References Cited

U.S. PATENT DOCUMENTS

| | | | |
|---|---|---|---|
| 2,958,328 | 11/1960 | Bartolomeo | 131/336 |
| 3,045,680 | 7/1962 | Smith | 131/336 |
| 3,124,143 | 3/1964 | Bartolomeo | 131/336 |
| 3,389,705 | 6/1968 | Levavi | 131/340 |
| 3,678,941 | 7/1972 | Dixon | 131/340 |
| 4,149,546 | 4/1979 | Luke et al. | 131/94 |
| 4,273,141 | 6/1981 | Van Tilburg | 131/340 |
| 4,388,934 | 6/1983 | Luke | 131/340 |
| 4,525,161 | 6/1985 | Luke | 131/341 |

FOREIGN PATENT DOCUMENTS

| | | |
|---|---|---|
| 0119693 | 9/1984 | European Pat. Off. |
| 1507765 | 4/1978 | United Kingdom |
| 2100573 | 1/1983 | United Kingdom |

*Primary Examiner*—V. Millin

*Attorney, Agent, or Firm*—Kane, Dalsimer, Sullivan, Kurucz, Levy, Eisele and Richard

[57] ABSTRACT

A method of making a ventilated cigarette filter plug in which a bore is thermally formed, by a laser beam for example, in a rod comprising a duct extending coaxially of the rod and matrix material surrounding the duct. The thermally formed bore extends through the matrix material to provide air-flow communication between the periphery of the rod and the interior of the duct.

7 Claims 1 Drawing

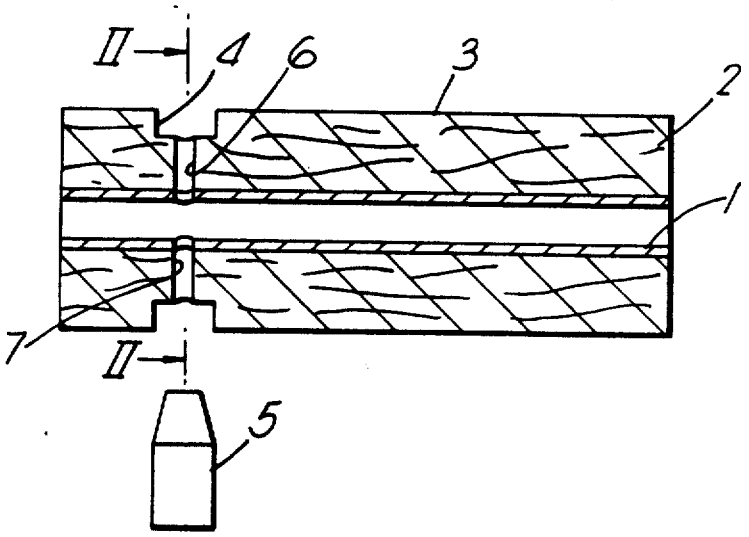

Fig. 1.
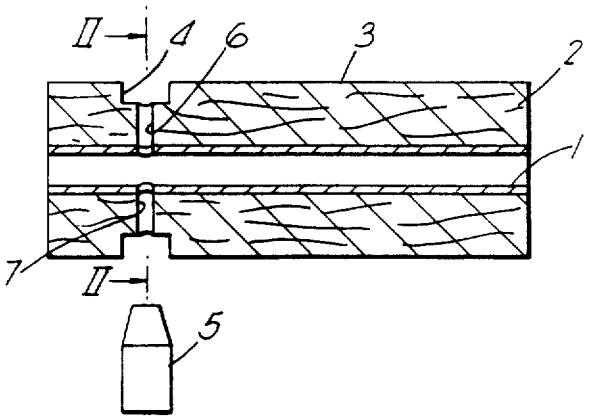
Fig. 2.
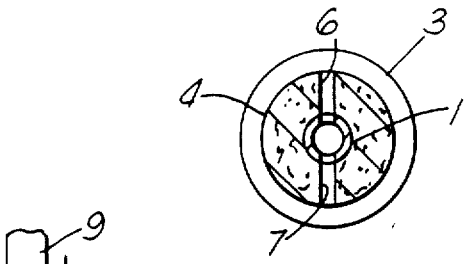
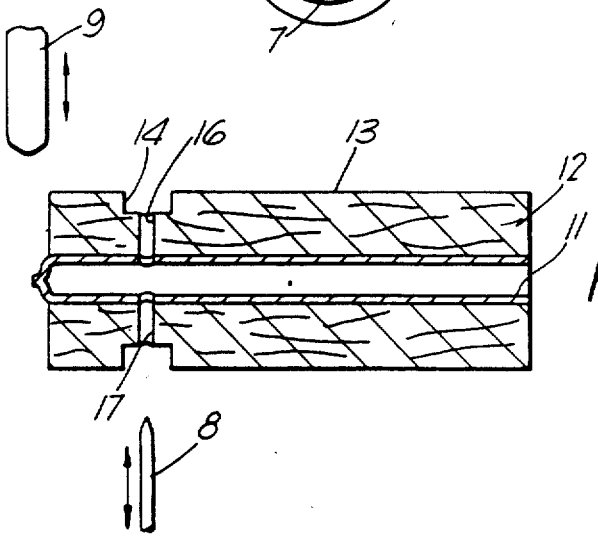
Fig. 3.